US011267619B2

(12) United States Patent
Pai

(10) Patent No.: US 11,267,619 B2
(45) Date of Patent: Mar. 8, 2022

(54) BOTTLE STOPPER

(71) Applicant: G. ESMOND INTERNATIONAL CO., LTD., Taoyuan (TW)

(72) Inventor: Kuan-Mu Pai, Taoyuan (TW)

(73) Assignee: G. ESMOND INTERNATIONAL CO., LTD., Taoyuan (TW)

( * ) Notice: Subject to any disclaimer, the term of this patent is extended or adjusted under 35 U.S.C. 154(b) by 279 days.

(21) Appl. No.: 16/542,281

(22) Filed: Aug. 15, 2019

(65) Prior Publication Data

US 2020/0216226 A1 Jul. 9, 2020

(30) Foreign Application Priority Data

Jan. 9, 2019 (TW) ..... 108200371

(51) Int. Cl.
*B65D 39/00* (2006.01)
*B65D 45/34* (2006.01)

(52) U.S. Cl.
CPC ..... *B65D 39/0052* (2013.01); *B65D 45/34* (2013.01)

(58) Field of Classification Search
CPC .... B65D 39/0052; B65D 45/34; B65D 39/12; B65D 45/06; B65D 39/00
USPC ..... 215/294
See application file for complete search history.

(56) References Cited

U.S. PATENT DOCUMENTS

| | | | | |
|---|---|---|---|---|
| 1,185,542 A * | 5/1916 | Roberts | B65D 39/12 | 215/361 |
| 2,685,380 A * | 8/1954 | Moeller | B65D 39/12 | 215/359 |
| 2006/0016778 A1* | 1/2006 | Park | B65D 39/12 | 215/359 |
| 2008/0197104 A1* | 8/2008 | Wang Wu | B65D 39/14 | 215/355 |

* cited by examiner

*Primary Examiner* — Anthony D Stashick
*Assistant Examiner* — L Kmet
(74) *Attorney, Agent, or Firm* — Chun-Ming Shih; HDLS IPR Services

(57) ABSTRACT

A bottle stopper contains: a first connection part, a second connection part, an actuation member, an operation unit, a fitting sleeve, and a base. The first connection part includes two opposite cutouts. The second connection part includes an aperture. The actuation member includes an extension sheet, a post, and a threaded portion. The operation unit includes two projections and a drive element, wherein each of the two projections is a cuboid, and two distal ends of the drive element are connected with two eccentric positions of two outer surfaces of the two projections respectively. The fitting sleeve is hollow and is fitted on the post below a bottom of the second connection part. The base includes a screwing orifice for screwing with the threaded portion of the actuation member, and the fitting sleeve is fitted on the base.

6 Claims, 5 Drawing Sheets

BOTTLE STOPPER

FIELD OF THE INVENTION

The present invention relates to a bottle stopper which seals an opening of a bottle tightly.

BACKGROUND OF THE INVENTION

A bottle is applied to accommodate fluid, for example, a glass bottle is applied to accommodate liqueur and its opening is sealed by a cork. However, after the cork is broken, it is difficult to block the opening of the bottle.

Accordingly, the bottle stopper is developed, but it cannot seal the opening of the bottle effectively. In addition, the bottle stopper is complicated and is produced at a high cost.

The present invention has arisen to mitigate and/or obviate the afore-described disadvantages.

SUMMARY OF THE INVENTION

The primary aspect of the present invention is to provide a bottle stopper which seals an opening of a bottle tightly To obtain above-mentioned aspect, a bottle stopper provided by the present invention contains: a first connection part, a second connection part, an actuation member, an operation unit, a fitting sleeve, and a base.

The first connection part includes two opposite cutouts defined on a peripheral side of the first connection part.

The second connection part is connected on a bottom of the first connection part, and a space is defined between the first connection part and the first connection part. The second connection part includes an aperture passing through a center of the second connection part.

The actuation member includes an extension sheet arranged on a top of the actuation member, a post extending from a center of a bottom of the extension sheet, and a threaded portion formed on a bottom of the post, the bottom of the post extending through the aperture of the second connection part.

The operation unit includes two projections and a drive element, wherein each of the two projections is a cuboid, and two distal ends of the drive element are connected with two eccentric positions of two outer surfaces of the two projections respectively. The two projections are located below the extension sheet, and the drive element extends through the two opposite cutouts of the first connection part.

The fitting sleeve is hollow and is made of flexible material, and the fitting sleeve is fitted on the post below a bottom of the second connection part.

The base includes a screwing orifice defined on a top of the base so as to screw with the threaded portion of the actuation member.

The fitting sleeve is fitted on the base.

Preferably, two through orifices of the first connection part are formed on a top of the first connection part so as to receive two screw bolts respectively. A cap is covered on the top of the first connection part, and the second connection part includes two hollow locking columns extending outside the aperture and screwed with the two screw bolts individually.

Preferably, the second connection part includes a stop protrusion extending from a center of the bottom of the second connection part.

Preferably, each of the two projections is a cuboid and has two opposite first faces and two opposite second faces, a length of each of the two opposite first faces is more than each of the two opposite second faces, and each projection further has an arcuate face defined on a connection portion of each first face and each second face.

Preferably, the drive element is formed in a string shape and is made of metal.

Preferably, the fitting sleeve is made of silicone.

DETAILED DESCRIPTION OF THE PREFERRED EMBODIMENTS

Figure 1:
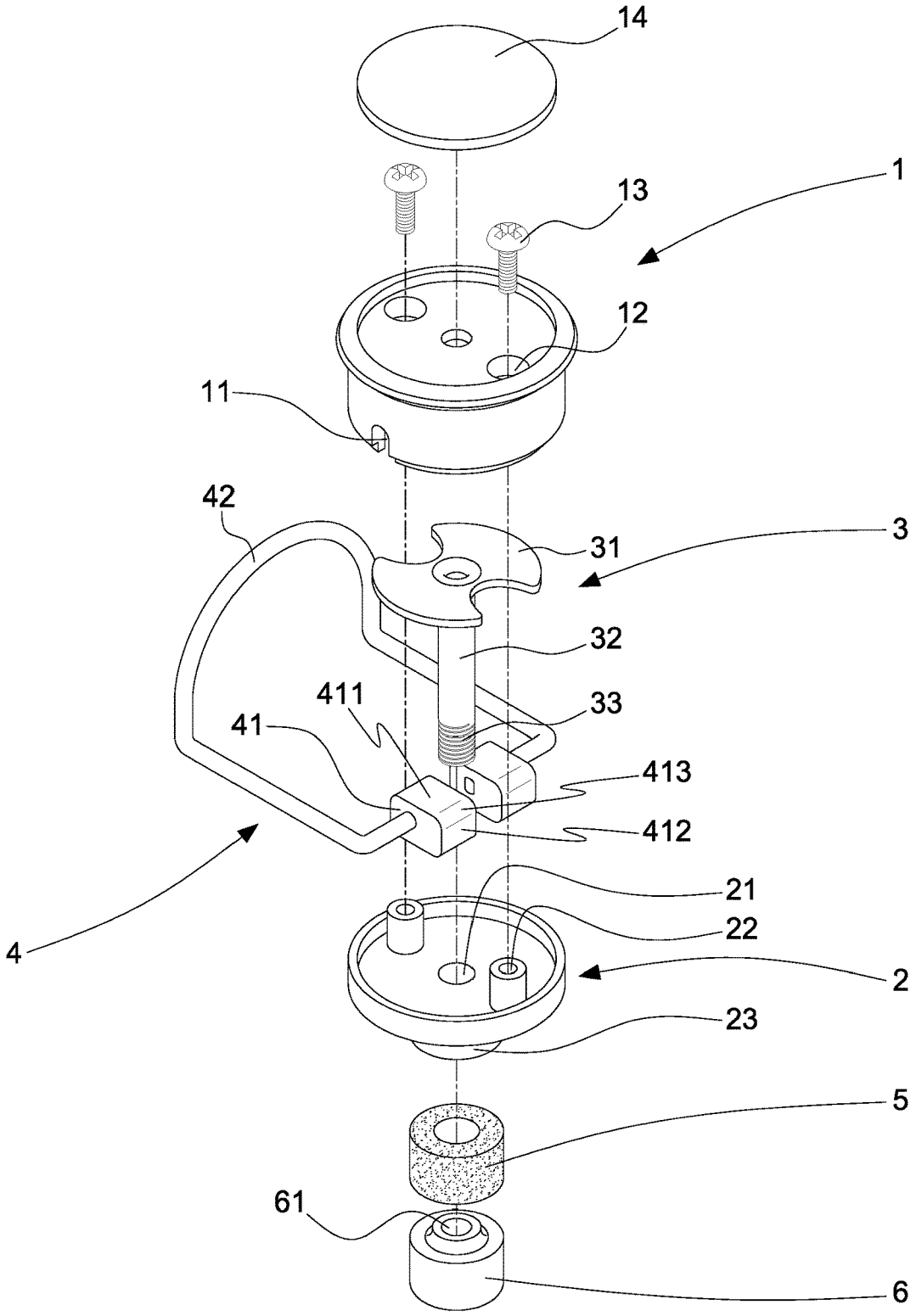
FIG. 1 is a perspective view showing the exploded components of a bottle stopper according to a preferred embodiment of the present invention.
Figure 2:
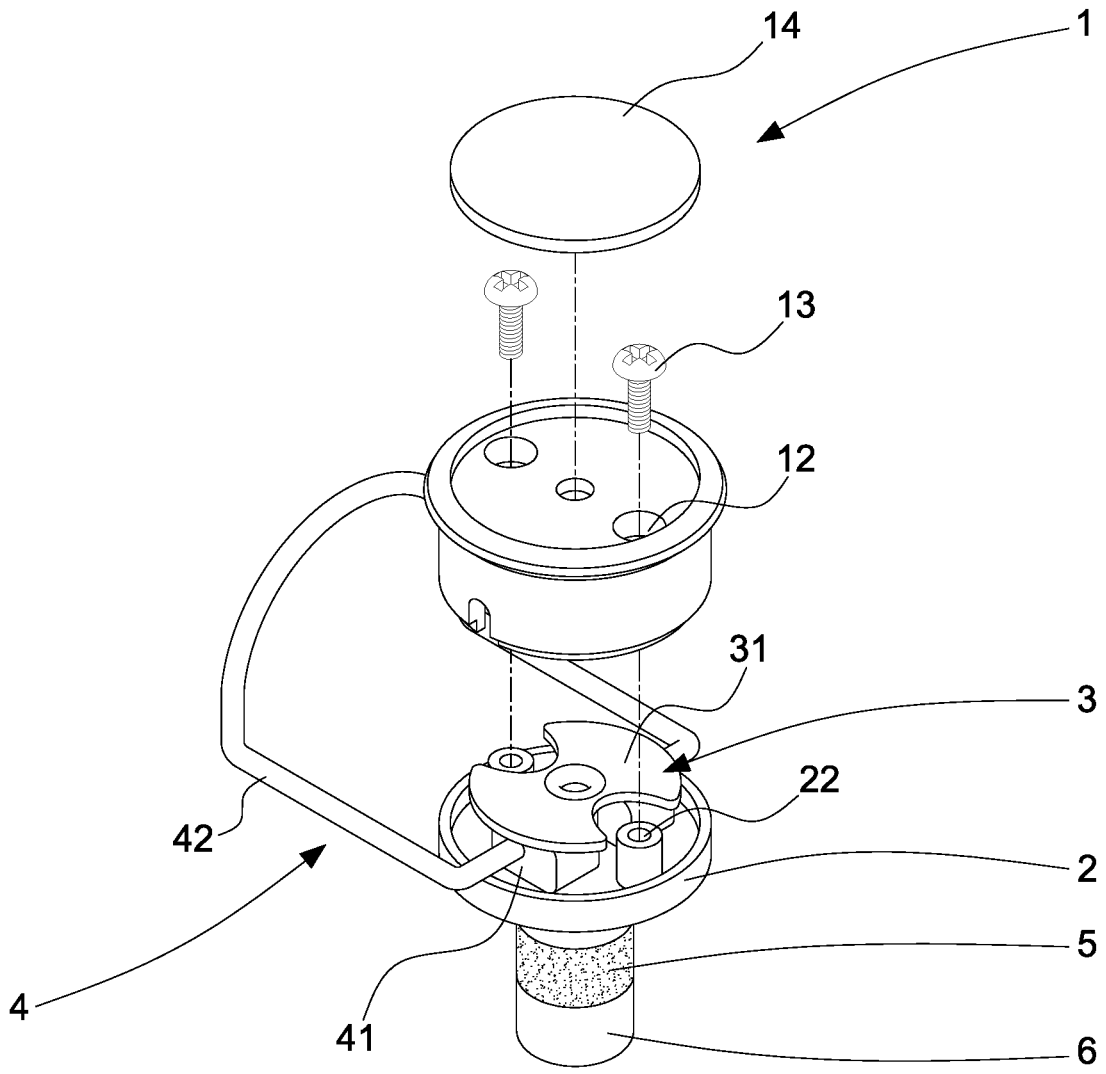
FIG. 2 is a perspective view showing the exploded components of the bottle stopper according to the preferred embodiment of the present invention.

With reference to FIGS. 1-4, a bottle stopper according to a preferred embodiment of the present invention comprises: a first connection part 1, a second connection part 2, an actuation member 3, an operation unit 4, a fitting sleeve 5, and a base 6.

The first connection part 1 is formed in a housing shape, and the first connection part 1 includes two opposite cutouts 11 defined on a peripheral side thereof, two through orifices 12 formed on a top of the first connection part 1 so as to receive two screw bolts 13 respectively, and a cap 14 covered on the top of the first connection part 1.

The second connection part 2 is connected on a bottom of the first connection part 1, and the second connection part 2 includes an aperture 21 passing through a center of the second connection part 2, two hollow locking columns 22 extending outside the aperture 21 and screwed with the two screw bolts 13 individually, and a stop protrusion 23 extending from a center of a bottom of the second connection part 2. A space is defined between the first connection part 2 and the first connection part 1.

The actuation member 3 is formed in an umbrella shape, and the actuation member 3 includes an extension sheet 31 arranged on a top of the actuation member 3, a post 32 extending from a center of a bottom of the extension sheet 31, and a threaded portion 33 formed on a bottom of the post 32, wherein the bottom of the post 32 extends through the aperture 21 of the second connection part 2.

The operation unit 4 includes two projections 41 and a drive element 42, wherein each of the two projections 41 is a cuboid and has two opposite first faces 411 and two opposite second faces 412, and a length of each of the two opposite first faces 411 is more than each of the two opposite second faces 412, wherein each projection 41 further has an arcuate face 413 defined on a connection portion of each first face 411 and each second face 412. The drive element 42 is formed in a string shape and is made of metal, and two distal ends of the drive element 42 are connected with the two projections 41, for example, the two distal ends of the drive element 42 are connected with two eccentric positions of two outer surfaces of the two projections 41 respectively. The two projections 41 are located below the extension sheet 31, and the drive element 42 extends through the two opposite cutouts 11 of the first connection part 1.

The fitting sleeve 5 is hollow and is made of flexible material (such as silicone), and the fitting sleeve 5 is located below the stop protrusion 23 of the second connection part 2 and accommodates the post 32.

The base 6 includes a screwing orifice 61 defined on a top thereof so as to screw with the threaded portion 33 of the actuation member 3, and the fitting sleeve 5 is fitted on the base 6.

Figure 3:
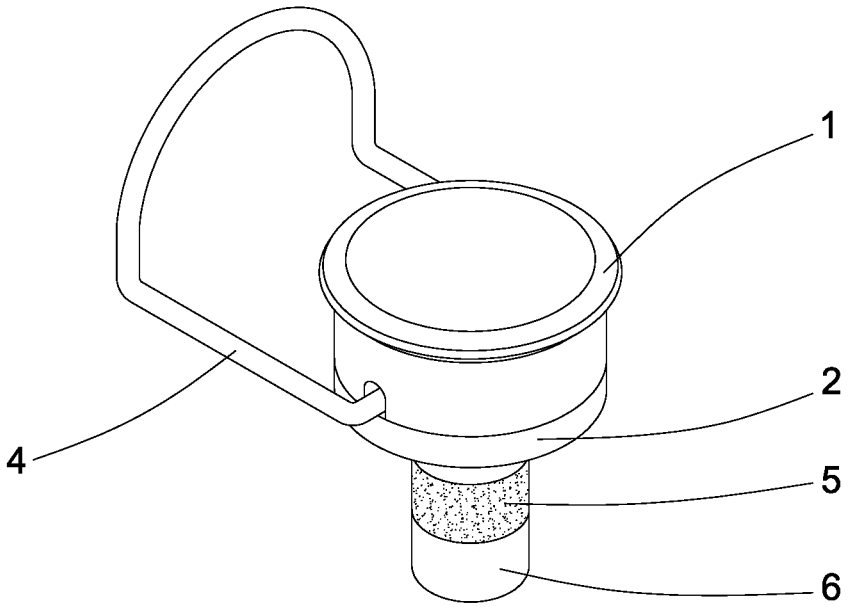
FIG. 3 is a perspective view showing the assembly of the bottle stopper according to the preferred embodiment of the present invention.
Figure 4:
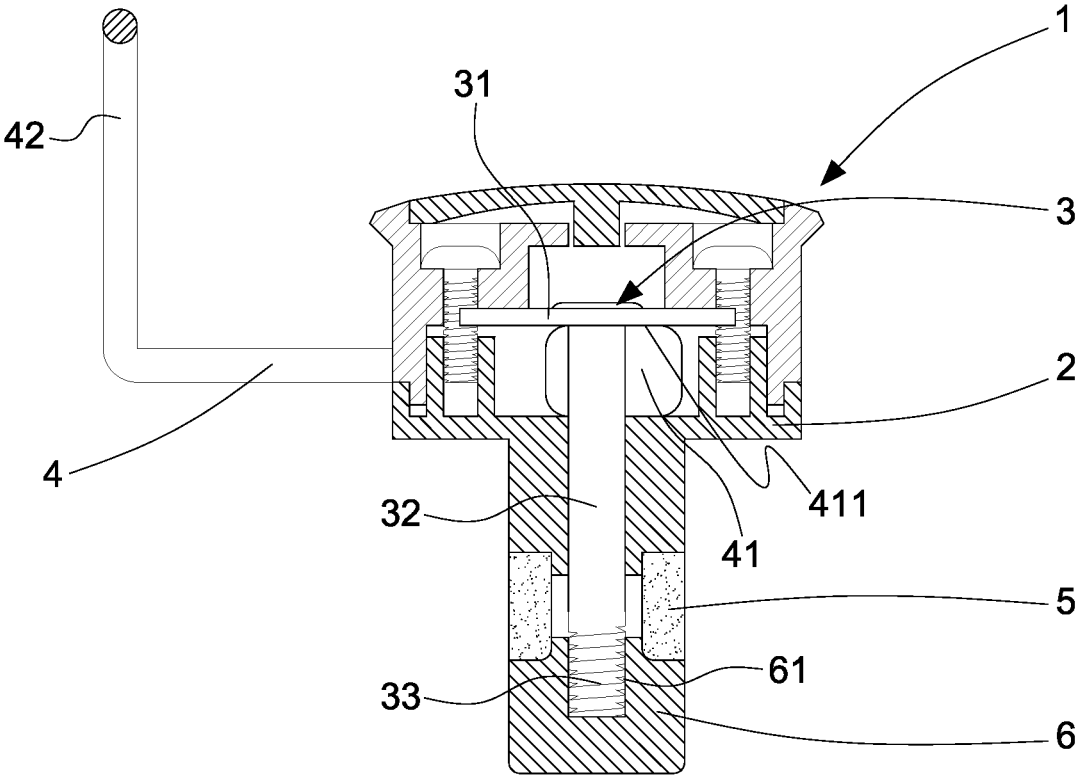
FIG. 4 is a cross sectional view showing the operation of the bottle stopper according to the preferred embodiment of the present invention.

Referring to FIGS. 3 and 4, the drive element 42 is parallelly located beside a peripheral side of the first connection part 1, wherein each projection 41 is located on one of the two opposite first faces 411 on a bottom of each projection 41 and contacts with a top of the second connection part 2, and the two opposite first faces 411 contact with the bottom of the extension sheet 31 and a top of the second connection part 2 respectively.

Figure 5:
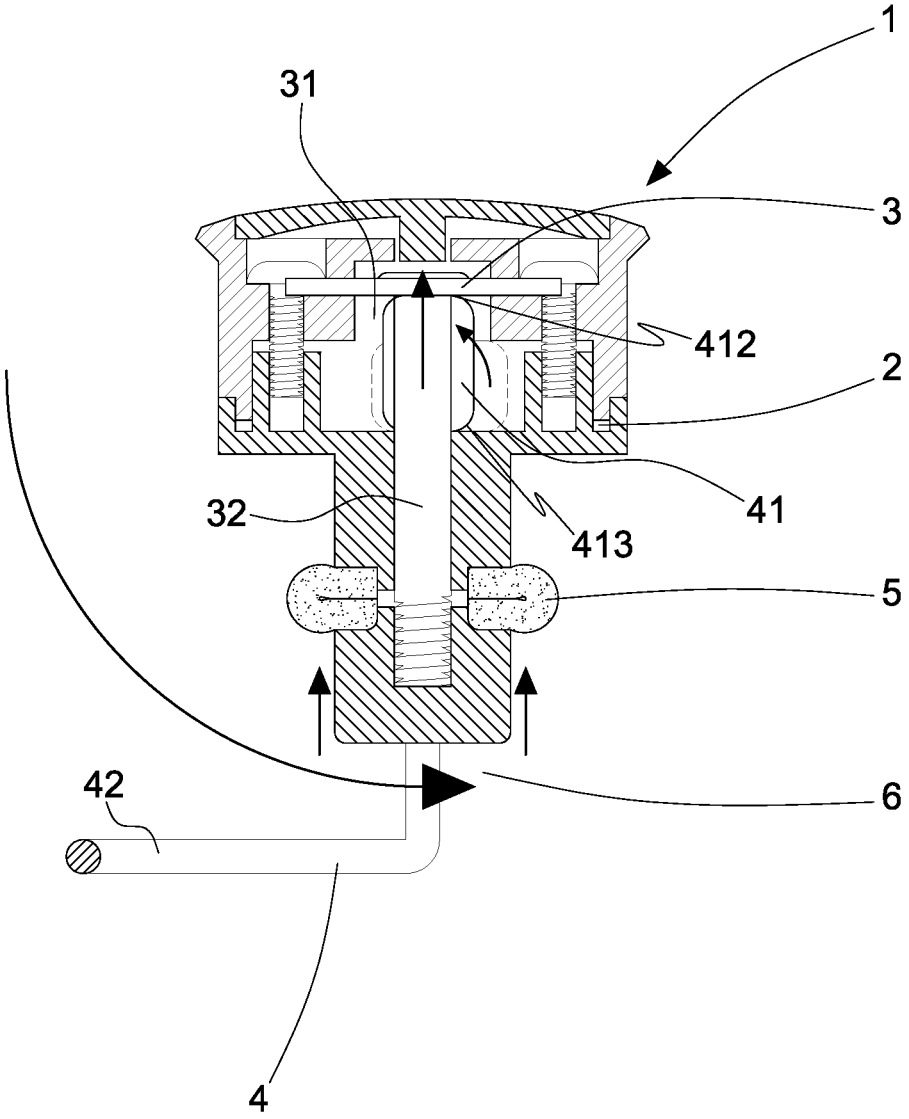
FIG. 5 is another cross sectional view showing the operation of the bottle stopper according to the preferred embodiment of the present invention.

As shown in FIG. 5, the drive element 42 is manually rotated downward after the bottle stopper is fitted on a bottle so as to drive the two projections 41 to turn, the two opposite first faces 411 do not contact with the bottom of the extension sheet 31 and the top of the second connection part 2 respectively, and the two opposite second faces 412 contact with the bottom of the extension sheet 31 and the top of the second connection part 2 respectively, such that the extension sheet 31 is lifted upward by the two projections 41 so as to actuate the post 32 and the base 6 to move upward. The fitting sleeve 5 is fitted on the base 6, and the stop protrusion 23 does not move, and the post 32 and the base 6 move upward, hence the fitting sleeve 5 is pressed to form a donut shape and to seal an opening of the bottle.

The drive element 42 is moved back to an original position so as to turn the two projections 41 back to original positions respectively, and the two opposite first faces 411 contact with the bottom of the extension sheet 31 and the top of the second connection part 2 respectively, hence a height of the two projections 41 reduces, and the extension sheet 31 is descended by the two projections 41 so as to actuate the post 32 and the base 6 to move downward, and the fitting sleeve 5 is released to remove from the opening of the bottle.

Preferably, a decoration element in various shapes (such as an animal doll or a cartoon doll) is arranged on a top of the cap 14.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A bottle stopper comprising:

a first connection part including two opposite cutouts defined on a peripheral side of the first connection part;

a second connection part connected on a bottom of the first connection part, and a space being defined between the first connection part and the second connection part; the second connection part including an aperture passing through a center of the second connection part;

an actuation member including an extension sheet arranged on a top of the actuation member, a post extending from a center of a bottom of the extension sheet, and a threaded portion formed on a bottom of the post, the bottom of the post extending through the aperture of the second connection part;

an operation unit including two projections and a drive element, wherein two distal ends of the drive element are connected with two eccentric positions of two outer surfaces of the two projections respectively; wherein the two projections are located below the extension sheet, and the drive element extends through the two opposite cutouts of the first connection part;

a fitting sleeve being hollow and being made of flexible material, and the fitting sleeve being arranged on the post below a bottom of the second connection part;

a base including a screwing orifice defined on a top of the base, and the threaded portion of the actuation member screw into the screwing orifice; and wherein the fitting sleeve sits on the base.

2. The bottle stopper as claimed in claim 1, wherein two through orifices of the first connection part are formed on a top of the first connection part so as to receive two screw bolts respectively; and a cap covers on the top of the first connection part; the second connection part includes two hollow locking columns extending outside the aperture and the two screw bolts are threaded through the two hollow locking columns, respectively.

3. The bottle stopper as claimed in claim 1, wherein the second connection part includes a stop protrusion extending from a center of the bottom of the second connection part.

4. The bottle stopper as claimed in claim 1, wherein each of the two projections is a block and has two opposite first faces and two opposite second faces, a length of each of the two opposite first faces is greater than a length of each of the two opposite second faces, and each projection further has a curved surface defined on a connection portion of each first face and each second face.

5. The bottle stopper as claimed in claim 1, wherein the drive element is formed in a bar shape and is made of metal.

6. The bottle stopper as claimed in claim 1, wherein the fitting sleeve is made of silicone.

* * * * *